US007797957B2

(12) United States Patent
Sunderland

(10) Patent No.: US 7,797,957 B2
(45) Date of Patent: Sep. 21, 2010

(54) METHODS AND APPARATUS FOR LINEARIZED TEMPERATURE CONTROL OF COMMERCIAL REFRIGERATION SYSTEMS

(75) Inventor: Ted W. Sunderland, Troy, MO (US)

(73) Assignee: Hussmann Corporation, Bridgeton, MO (US)

( * ) Notice: Subject to any disclaimer, the term of this patent is extended or adjusted under 35 U.S.C. 154(b) by 1019 days.

(21) Appl. No.: 11/279,415

(22) Filed: Apr. 12, 2006

(65) Prior Publication Data

US 2007/0240440 A1 Oct. 18, 2007

(51) Int. Cl.
*F25B 1/00* (2006.01)
*F25B 41/00* (2006.01)
*F25B 1/10* (2006.01)

(52) U.S. Cl. ..... 62/228.3; 62/208; 62/212; 62/228.1; 62/510

(58) Field of Classification Search ..... 62/228.3, 62/208, 212, 228.1, 510
See application file for complete search history.

(56) References Cited

U.S. PATENT DOCUMENTS 4,571,951 A * 2/1986 Szymaszek ..... 62/212
4,646,535 A * 3/1987 Matsuoka et al. ..... 62/228.5
4,841,734 A 6/1989 Torrence
5,214,930 A 6/1993 Bendtsen
5,440,891 A 8/1995 Hindmon, Jr. et al.
5,533,347 A 7/1996 Ott et al.
5,586,444 A * 12/1996 Fung ..... 62/117
6,378,315 B1 4/2002 Gelber et al.
6,647,735 B2 11/2003 Street et al.
2003/0010047 A1 * 1/2003 Shimoda ..... 62/228.3
2004/0016241 A1 1/2004 Street et al.
2007/0006606 A1 * 1/2007 Kaga et al. ..... 62/354

OTHER PUBLICATIONS

Joel W. Vandenbrink, Richard C. Potter and David M. Huhn; Design of a Refrigeration Cycle Evaporation Unit; Prepared for : EGR 360, Dr. Ali Mohammadzadeh; Grand Valley State University, MI, Apr. 18, 2003; pp. 1-21.
The PID Control Algorithm; http://www.jashaw.com/pid/description.htm; pp. 1-5.
Wizard WCC-T—Parallel Compressor Control System—Temperature Control; http://www.genesis-international.com/products/compressor_ctrl/WCC-T.html; pp. 1-3.
Advanced Features in PID Tuning; http://zone.ni.com/devzone/conceptd.nsf/webmain/5CFF973C0DB2C48186257028004DBBAF; pp. 1-8.

* cited by examiner

*Primary Examiner*—Frantz F. Jules
*Assistant Examiner*—Travis Ruby
(74) *Attorney, Agent, or Firm*—Michael Best & Friedrich LLP

(57) ABSTRACT

Methods, systems, and apparatus for linearizing control of a commercial refrigeration system. In an embodiment of the invention, a controller is configured to receive a non-linear sensed suction pressure and convert the suction pressure to a linear temperature equivalent. The linear temperature equivalent is used by the controller to achieve efficient system operation over an entire range of operating temperatures.

12 Claims, 8 Drawing Sheets

METHODS AND APPARATUS FOR LINEARIZED TEMPERATURE CONTROL OF COMMERCIAL REFRIGERATION SYSTEMS

BACKGROUND

One function of control systems applied to commercial refrigeration systems is to control cooling capacity in response to variations in refrigeration load. Often this involves on/off control of fixed speed compressors and/or variable control of variable speed compressors. When multiple compressors in a parallel arrangement are used to provide refrigeration to a plurality of evaporators operating at varying temperatures, suction pressure is generally used as a control variable input to the control system. Often a controller implementing a proportional-integral-derivative control algorithm processes a sensed suction pressure common to all the compressors in the parallel arrangement and determines a control output for one or more compressors to maintain cooling capacity at a level that closely matches the refrigeration load presented by the plurality of evaporators.

Suction pressure, being representative of temperature in the attached evaporator coil(s), is non-linear over the range of operating evaporator temperatures required in a typical commercial refrigeration system, and controllers implementing proportional-integral-derivative ("PID") control algorithms do not operate efficiently on non-linear functions. Therefore, the use of a controller implementing a PID control algorithm in a commercial refrigeration system results in inefficient operation of the commercial refrigeration system or in additional cost for tuning of the PID control algorithm to specific operating parameters as required by the application.

SUMMARY

In one embodiment, the invention provides a commercial refrigeration system including compressors, condensers, expansion valves, a pressure sensor, and a controller. The pressure sensor senses a suction pressure for the compressors. The controller receives a temperature set-point and the sensed suction pressure, determines a temperature equivalent to the sensed suction pressure, and adjusts an element of the system to correct for a differential between the temperature set-point and the determined temperature equivalent.

In another embodiment, the invention provides a controller for a commercial refrigeration system linearly operable over a temperature range. The controller includes a sensor for detecting a suction pressure, a converter configured for converting the suction pressure to an equivalent temperature, and a PID controller. The PID controller receives the equivalent temperature, a temperature set-point, and a set of static control parameters, and generates an output that provides linear control over the entire temperature range.

In another embodiment, the invention provides a linear control method for a commercial refrigeration system. The method provides, to a controller, a set of control parameters that are static over a range of control and a temperature set-point; senses a suction pressure; determines a temperature equivalent to the sensed suction pressure; and adjusts an output based on a difference between the temperature set-point and the temperature equivalent.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Although embodiments herein focus on commercial refrigeration systems, other embodiments can be implemented in non-commercial settings.

Figure 1:
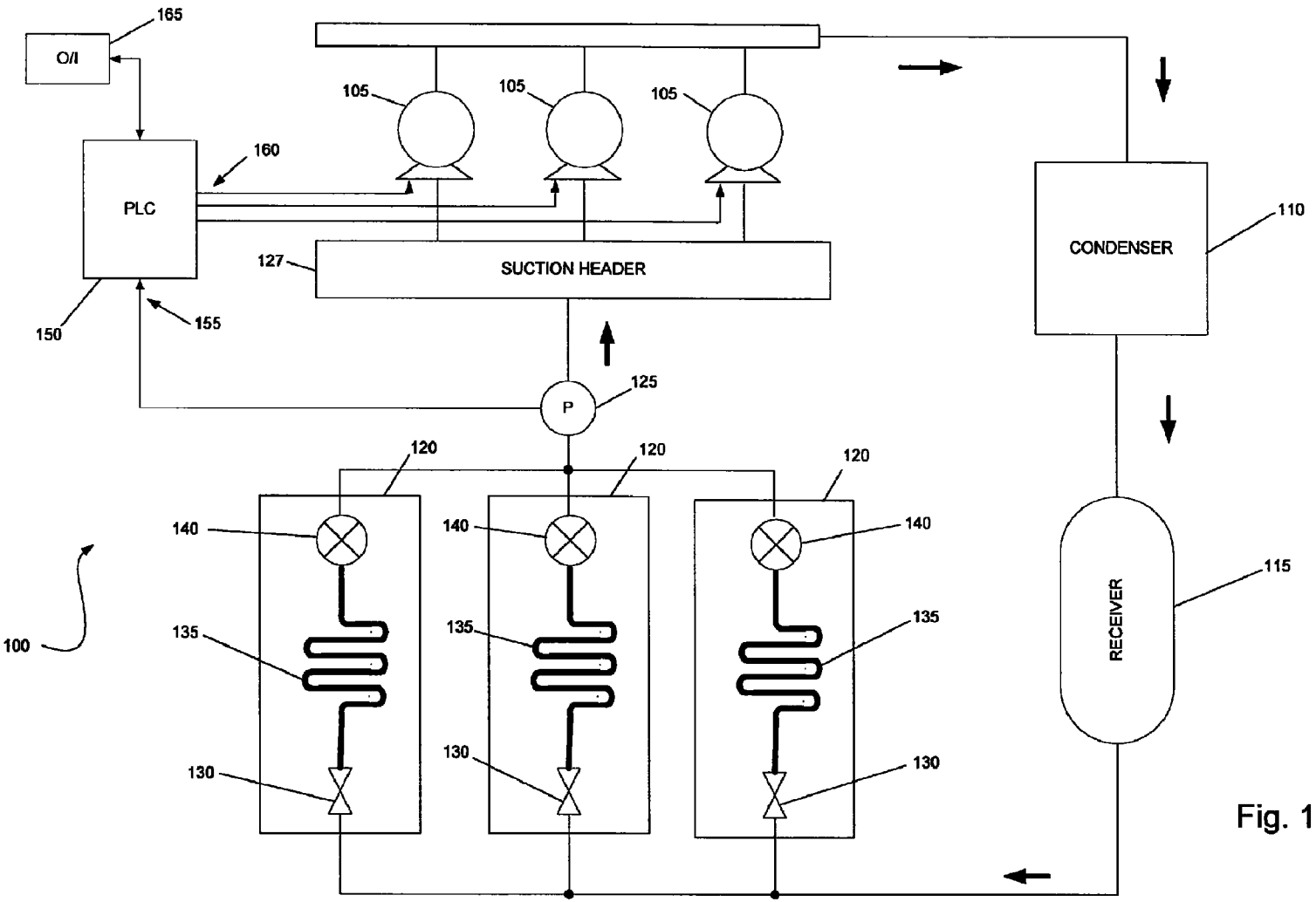
FIG. 1 illustrates a block diagram of an exemplary commercial refrigeration system.

FIG. 1 is a block diagram of an exemplary commercial refrigeration system 100. The commercial refrigeration system 100 includes at least one compressor 105, a condenser 110, a receiver 115, at least one display case 120, a pressure sensor 125, and a suction header 127. Each display case 120 includes an expansion valve 130, an evaporator 135, and a pressure regulator 140.

In some embodiments, operation of the commercial refrigeration system 100 is controlled by a programmable logic controller ("PLC") 150 (e.g., a ControlLogix model manufactured by Rockwell Automation Allen-Bradley, Milwaukee, Wis.).

The PLC 150 can include an analog input 155 which receives an indication of the suction pressure from a pressure sensor 125. The PLC 150 can also include outputs 160 for controlling each of the compressors 105. The PLC outputs can be digital outputs for controlling one or more fixed compressors (i.e., on or off) and/or can be analog outputs for controlling one or more variable compressors 105 (i.e., 0% to 100%).

The PLC 150 can also communicate with an operator interface 165 (e.g., a PanelView model manufactured by Rockwell Automation Allen-Bradley, Milwaukee, Wis.). The operator interface 165 can provide an operator with information on the operation of the commercial refrigeration system 100 and can enable the operator to enter and/or edit operating parameters (e.g., suction pressure set-point) in the commercial refrigeration system 100.

In some embodiments, the display cases 120 each have a temperature set-point at which the commercial refrigeration system 100 attempts to maintain the temperature. Table 1 shows some typical temperature settings for display cases based on the type of product stored therein. Each installation of the commercial refrigeration system 100 can have a different configuration of display cases 120, and the temperature of each display case 120 can be set individually.

TABLE 1

Typical Display Case Temperatures

| Product | Temperature |
|---|---|
| Ice Cream, Frozen Bakery | −25° F. to −10° F. |
| Frozen Foods | −15° F. to 0° F. |
| Meats, Seafood | 20° F. to 30° F. |
| Dairy, Produce, Juice | 25° F. to 40° F. |
| Produce, Flowers | 45° F. to 60° F. |

The compressor 105 compresses a refrigerant in the commercial refrigeration system 100 to provide cooling capacity for the system. In a commercial refrigeration system 100 with more than one compressor 105, the compressors 105 can turn on and off at the same or different times to meet the demand required by the system. In some embodiments, all of the compressors 105 are of one or more fixed capacities, and a control system stages the compressors into the system as necessary. In other embodiments, one or more of the compressors 105 has a variable capacity. As system demand changes, the output of the variable compressor 105 can be modified to meet the demand. When the variable compressor 105 is running at a predetermined threshold of its capacity (e.g., 5% or 15%), another compressor 105 can be staged in or out of the system, and the output of the variable compressor 105 modified, to meet the demand.

A relationship exists between the pressure of a refrigerant and the temperature of that refrigerant. The relationship is different for each type of refrigerant. Table 2 shows the relationship for two common types of refrigerants, R-12 and R-22.

TABLE 2

Temperature vs. Pressure (psig)

| Temp. | Pressure (psig) | |
|---|---|---|
| (° F.) | R-12 | R-22 |
| −18 | 1.3 | 11.3 |
| −16 | 2.1 | 12.5 |
| −14 | 2.8 | 13.8 |
| −12 | 3.7 | 15.1 |
| −10 | 4.5 | 16.5 |
| −8 | 5.4 | 17.9 |
| −6 | 6.3 | 19.3 |
| −4 | 7.2 | 20.8 |
| −2 | 8.2 | 22.4 |
| 0 | 9.2 | 24 |
| 2 | 10.2 | 25.6 |
| 4 | 11.2 | 27.3 |
| 6 | 12.3 | 29.1 |
| 8 | 13.5 | 30.9 |
| 10 | 14.6 | 32.8 |
| 12 | 15.8 | 34.7 |
| 14 | 17.1 | 36.7 |
| 16 | 18.4 | 38.7 |

TABLE 2-continued

Temperature vs. Pressure (psig)

| Temp. | Pressure (psig) | |
|---|---|---|
| (° F.) | R-12 | R-22 |
| 18 | 19.7 | 40.9 |
| 20 | 21 | 43 |
| 22 | 22.4 | 45.3 |
| 24 | 23.9 | 47.6 |
| 26 | 25.4 | 49.9 |
| 28 | 26.9 | 52.4 |
| 30 | 28.5 | 54.9 |
| 32 | 30.1 | 57.5 |
| 34 | 31.7 | 60.1 |
| 36 | 33.4 | 62.8 |
| 38 | 35.2 | 65.6 |
| 40 | 36.9 | 68.5 |
| 42 | 38.8 | 71.5 |
| 44 | 40.7 | 74.5 |
| 46 | 42.7 | 77.6 |
| 48 | 44.7 | 80.7 |
| 50 | 46.7 | 84 |
| 52 | 48.8 | 87.3 |
| 54 | 51 | 90.8 |
| 56 | 53.2 | 94.3 |
| 58 | 55.4 | 97.9 |
| 60 | 57.7 | 101.6 |

In the commercial refrigeration system 100, refrigerant flows from the display cases 120 through common piping to a suction header 127. The suction header 127 returns the refrigerant in the system to the compressors 105 operating in the system. In a commercial refrigeration system, the relationship between pressure and temperature can be used to control the cooling capacity of the commercial refrigeration system. Different operating conditions in each display case 120 (e.g., defrost cycles) may make it impractical to control the compressors 105 based on temperatures sensed in the display cases 120. Instead, a pressure of the refrigerant at the suction header 127 can indicate the maximum cooling capacity of the system 100 and can be used to control the operation of the compressors 105.

In each display case 120, the pressure of the refrigerant in the display case 120 is controlled by a respective pressure regulator 140. The pressure regulators 140 maintain the individual temperature set-points for each display case 120 by adjusting the pressure of the refrigerant in the evaporator 135 of the display case 120. To increase the temperature in the display case 120, the pressure regulator 140 can partially or completely close to increase the pressure of the refrigerant in the evaporator 135. To reduce the temperature in the display case 120, the pressure regulator 140 can open to reduce the pressure of the refrigerant in the evaporator 135. If the cooling capacity of the system 100 is not high enough to achieve a desired temperature in a display case 120, the pressure regulator 140 can open completely, but the temperature in the display case 120 will only go as low as the cooling capacity of the commercial refrigeration system.

A pressure sensor 125 located in the common piping leading to the suction header 127 senses the pressure of the refrigerant before it enters the suction header. As discussed above, the pressure of the refrigerant relates directly to a temperature. The sensed pressure, therefore, is indicative of the maximum cooling capacity of the commercial refrigeration system 100. By running the compressors 105, such that the sensed suction pressure is at or below the pressure that corresponds to the lowest temperature set-point in the system, the system 100 can ensure that enough cooling capacity exists to meet the demands of the commercial refrigeration system 100.

Figure 2:
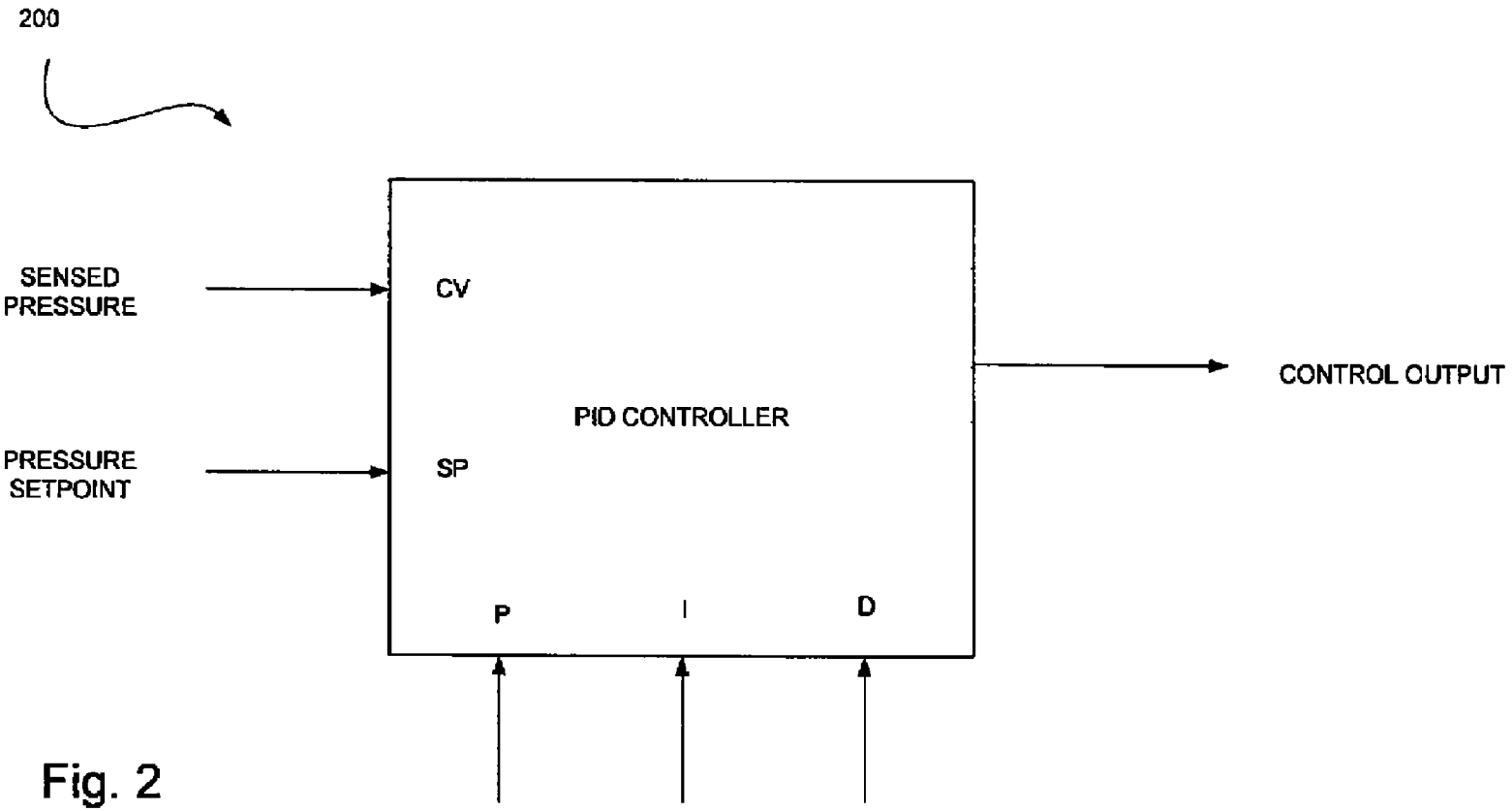
FIG. 2 illustrates a block diagram of an exemplary proportional-integral-derivative controller.

FIG. 2 is a block diagram of an exemplary PID controller 200 which can be used to control the cooling capacity of a commercial refrigeration system. PID controllers are closed loop controllers with several inputs including a measured control variable ("CV"), a desired reference value or set-point ("SP"), and several tuning elements including a proportional element ("P") or gain, an integral element ("I"), and a derivative element ("D"). Based on the values of the CV, the SP, and the tuning elements, the PID controller controls an output in an attempt to move the control variable to the set-point. The control variable is sensed by a control system (e.g., a suction pressure in a commercial refrigeration system). The control variable is compared to the set-point, and the difference between the control variable and the set-point is referred to as the error.

PID controllers generally operate effectively for control variables that can be modeled as linear functions. The proportional component ("P") of the PID controller represents a ratio of the change in an output, to the change in an input, or how much the input would have to vary from a set-point to cause the output to move from 0% to 100%. For example, if P is set to 10° F., a 10° F. difference (error) between the sensed value and the set-point can cause the output to go to 100%. A difference of 5° F. between the sensed value and the set-point can cause the output to go to 50%.

The integral component ("I") compensates for the past functioning of the system by integrating the errors over time. The derivative component ("D") attempts to anticipate the future by calculating the rate of change of the error over time.

Some commercial refrigeration systems use PID controllers to control compressors based on a sensed suction pressure in order to achieve an appropriate level of cooling capacity.

For example, in a commercial refrigeration system attempting to maintain a cooling capacity of 10° F. using R-22 refrigerant, the set-point of a PID controller is 32.8 pounds per square inch gauge ("psig") (from Table 2). The suction pressure is sensed and provided to the PID controller as the control variable. Based on the error (i.e., the difference between the sensed suction pressure and the set-point), the PID controller, using the tuning elements (P, I, and D), determines an amount to modify a control output controlling compressors such that the sensed suction pressure corrects toward the set-point and reduces the error to zero.

Figure 3:
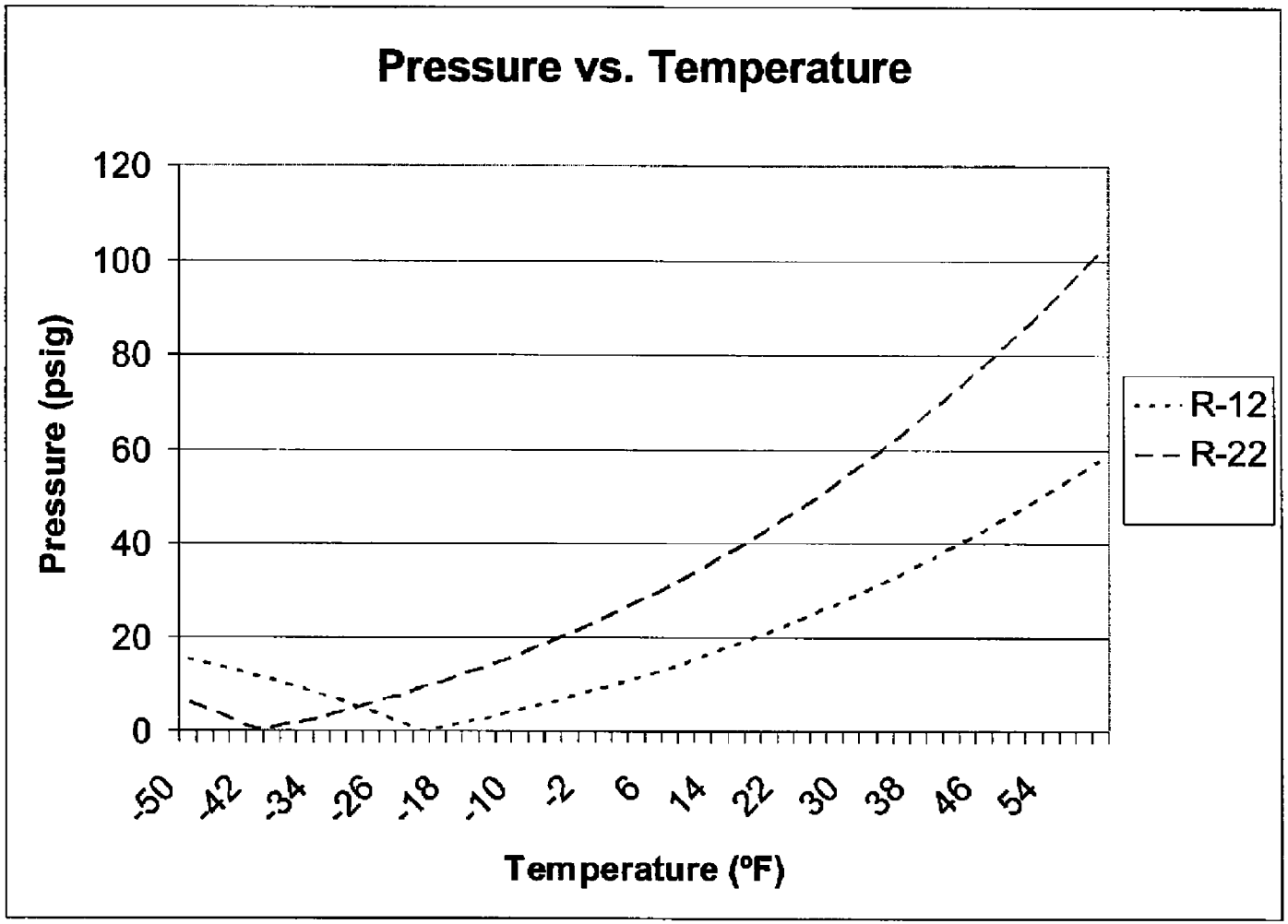
FIG. 3 graphically illustrates the relationship of pressure to temperature for two common refrigerants.

Because PID controllers are designed to control linear processes, and refrigerant pressures are not linear, especially over the full range of temperatures typically found in display cases of commercial refrigeration systems, shortcomings exist in PID controllers such as shown in FIG. 2. FIG. 3 shows a graph of the refrigerant pressures versus temperatures for two common types of refrigerants, R-12 and R-22, and plots the values shown in Table 2. The graph shows the non-linear relationship between pressure and temperature for the two refrigerants. A commercial refrigeration system using PID control and designed to operate with a minimum display case temperature of 0° F. (e.g., a system for a grocery store) would not function as efficiently if the commercial refrigeration system were used in an application where the minimum display case temperature was 40° F. (e.g., a florist). This is because the slope at each point of the pressure versus temperature curves (either the R-12 or R-22 curves of FIG. 3) is different at each temperature.

For example, a commercial refrigeration system using R-22 refrigerant and designed to maintain a cooling capacity of 0° F. can have a set-point of 0° F. and a P value of 2° F. If a sensed temperature (i.e., the control variable) was equal to 2° F., the control output would go to 100% assuming P was the only tuning variable used in the PID control.

As stated previously, it is impractical for a commercial refrigeration system to use temperature as the control variable of the PID controller. Instead, commercial refrigeration systems use suction pressure as the control variable input to the PID controller. Using the above examples, a commercial refrigeration system attempting to maintain a cooling capacity of 0° F. has a set-point of 24 psig (Table 2). The P variable equivalent to 2° F. is 1.6 psig (25.6 psig-24 psig). Alternatively, a larger P variable, equivalent to 10° F., is equal to 8.8 psig (32.8 psig-24 psig). As a result of the non-linearity of the refrigerant over the temperature range, a rise of 4° F. in the cooling capacity, using the larger P variable, results in a control output of 37.5% (27.3 psig (4° F.)-24.0 psig (0° F.)=3.3 psig, 3.3 psig/8.8 psig=37.5%), when the desired control output is actually 40% (4° F./10° F.), again assuming P was the only tuning variable used in the PID control.

For a commercial refrigeration system 100 in which the minimum display case 120 temperature is 40° F., the set-point is 68.5 psig when using R-22 refrigerant. If the commercial refrigeration system 100 is tuned for a minimum display case 120 temperature of 0° F., and a 10° F. equivalent P, the P is 8.8 psig.

If the temperature in the display case 120 rises by 2° F. to 42° F., the pressure of the refrigerant is 71.5 psig. The resulting error is 3.0 psig (71.5 psig-68.5 psig). The control output is 3.0 psig/8.8 psig=34.1% (with P control only). In this scenario, the non-linearity results in a nearly 75% increase in output beyond the desired 20%.

The excessive output, shown in the example above, can result in additional compressors 105 being staged into the system beyond what is necessary to correct the error. The resulting overcapacity can cause the cooling capacity of the commercial refrigeration system 100 to exceed what is required and result in one or more compressors being staged out of the system. Similar to the excessive output determined above, the correction output can result in more compressors being staged out of the system than should be to correct the error. This cycling of compressors can result in a reduction of the useful life of the compressors and increased repair and maintenance costs. In addition, the inefficiencies of cycling the compressors can also result in increased energy usage and cost.

Therefore, the P, I, and D parameters of a PID controller must be tuned for the specific application of the commercial refrigeration system to reduce inefficiencies. Furthermore, should the configuration of an installation of a commercial refrigeration system change, re-tuning of the commercial refrigeration system would be required to maintain efficient operation. Tuning involves setting the P, I, and D parameters to optimum values based on, among other things, the slope of the curve of the pressures (as shown in FIG. 3) around the set-point. As discussed above, the location of the set-point in the curve (the operating range) of the commercial refrigeration system can impact the optimum values for the tuning variables. To optimize control at a 68.5 psig (40° F.) set-point in the example above, the equivalent P for 10° F. is 15.5 psig (84 psig (50° F.)-68.5 psig (40° F.)).

As shown in FIG. 3, the type of refrigerant can also have a large impact on the optimum values for the tuning variables because the slopes of the temperature versus pressure curves for each type of refrigerant can vary greatly from one type of refrigerant to another.

As described above, PID controllers operate most efficiently for control variables that can be modeled as linear functions. This presents difficulties when suction pressure is used as the control variable in commercial refrigeration systems as suction pressure has a non-linear relationship to temperature. Using temperature as the control variables of a PID controller in a commercial refrigeration system would provide a linear function (e.g., a 1° F. change at 0° F. is the same as a 1° F. change at 40° F.) and would result in the effective operation of the PID controller. However, as described above, the use of temperature as a control variable in a commercial refrigeration system is impractical. Therefore, the invention provides systems and methods of modeling suction pressure as a linear function by converting the suction pressure to an equivalent linear temperature.

Figure 4A:
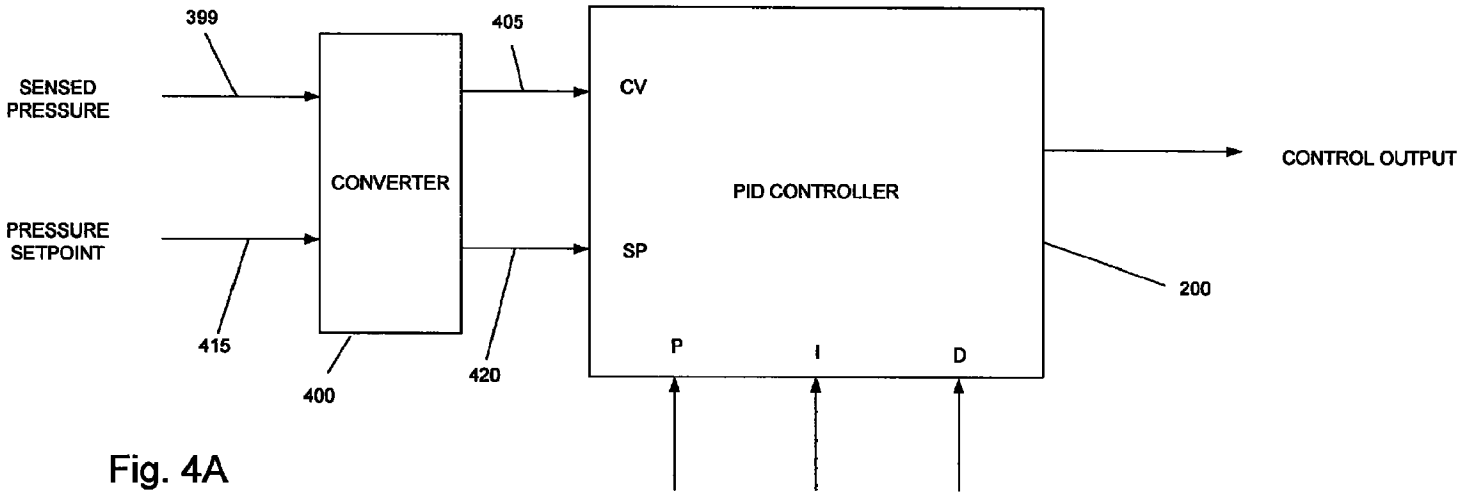
FIGS. 4A and 4B are block diagrams of embodiments of modified proportional-integral-derivative controllers according to the invention.
Figure 4B:
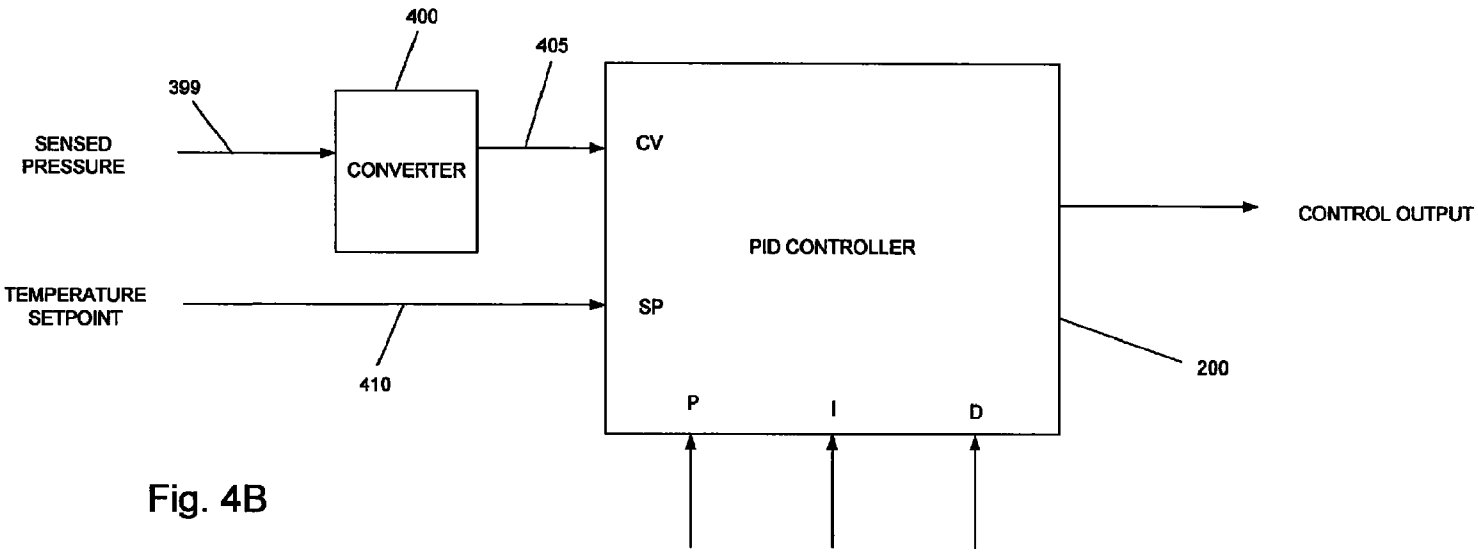

FIGS. 4A and 4B illustrate embodiments of a PID controller according to the invention. A sensed suction pressure 399 is provided to a converter 400. The converter 400 computes an equivalent temperature 405 based on the sensed suction pressure 399 and the type of refrigerant used by the system. The computed equivalent temperature 405 is then provided, as the control variable input, to the PID controller 200.

In some embodiments, the converter 400 determines the equivalent temperature 405 using the sensed suction pressure 399 and the type of refrigerant in a calculation. In other embodiments, the converter 400 looks up the sensed suction pressure 399 in a table and locates the equivalent temperature 405 in the table. The calculation and/or look up table are tailored for each type of refrigerant.

The set-point input of the PID controller is of the same type (e.g., temperature or pressure) as the control variable. Therefore, when the estimated temperature 405 is provided to the PID controller 200 as the control variable input, a temperature value is provided to the PID controller 200 as the set-point input. FIG. 4A shows an embodiment of the invention in which a suction pressure set-point 415 is provided to the converter 400. The converter 400 converts the suction pressure set-point 415 to an equivalent temperature set-point 420 (e.g., in the same way the converter 400 converted the sensed suction pressure 399 to an equivalent temperature 405). The equivalent temperature set-point 420 is provided as the set-point input to the PID controller 200.

FIG. 4B shows an alternative embodiment of the invention in which a temperature set-point 410 is provided directly to the PID controller 200 as the set-point input.

In some embodiments, the P, I, and D parameters are entered into the PID controller 200 at the time the commercial refrigeration system is manufactured. Because temperature is linear, it is not generally necessary to tune the PID controller for each refrigerant type or system configuration.

Figure 5:
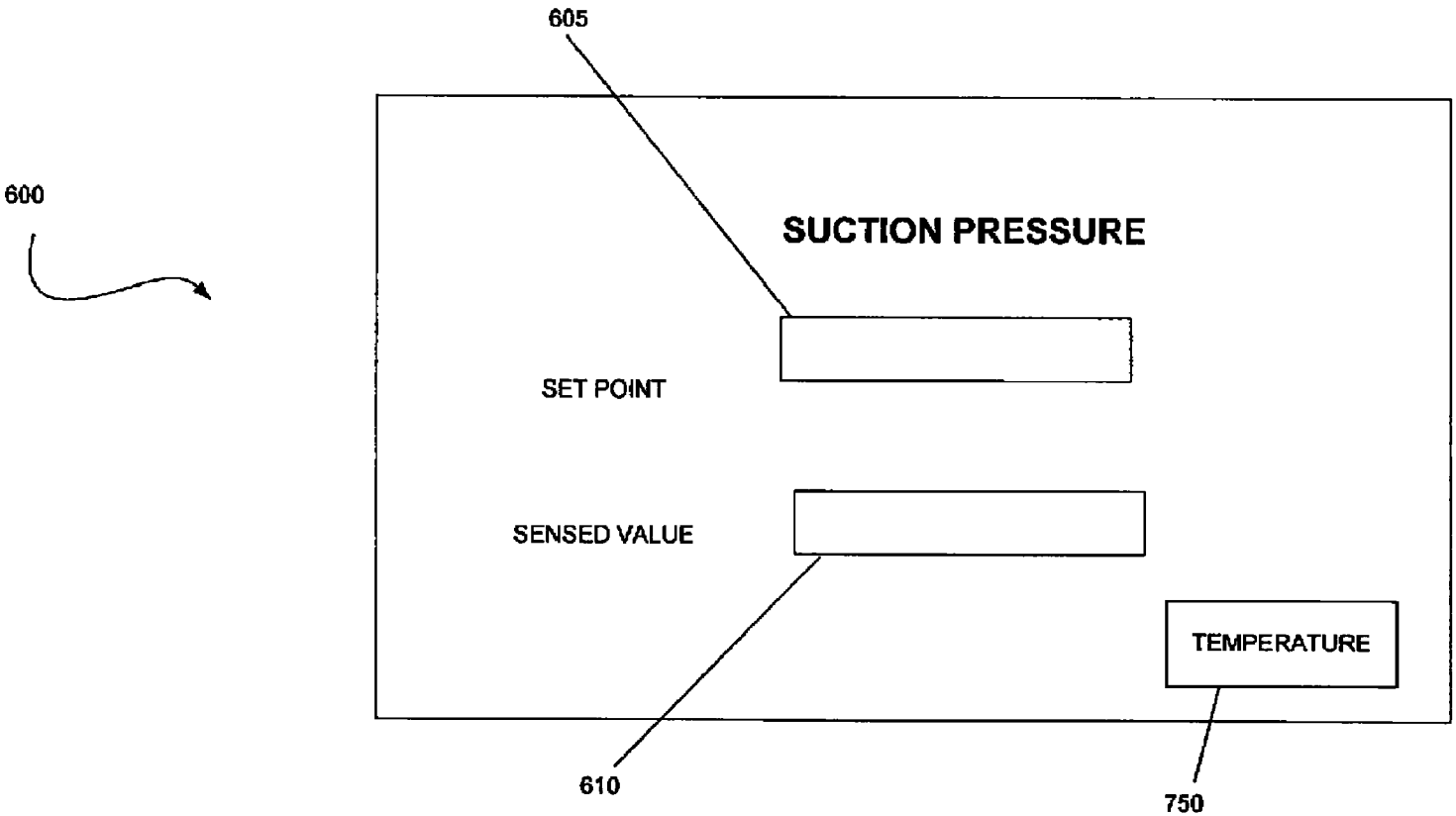
FIG. 5 illustrates an exemplary operator interface screen for entering a suction pressure set-point into a commercial refrigeration system.
Figure 6:
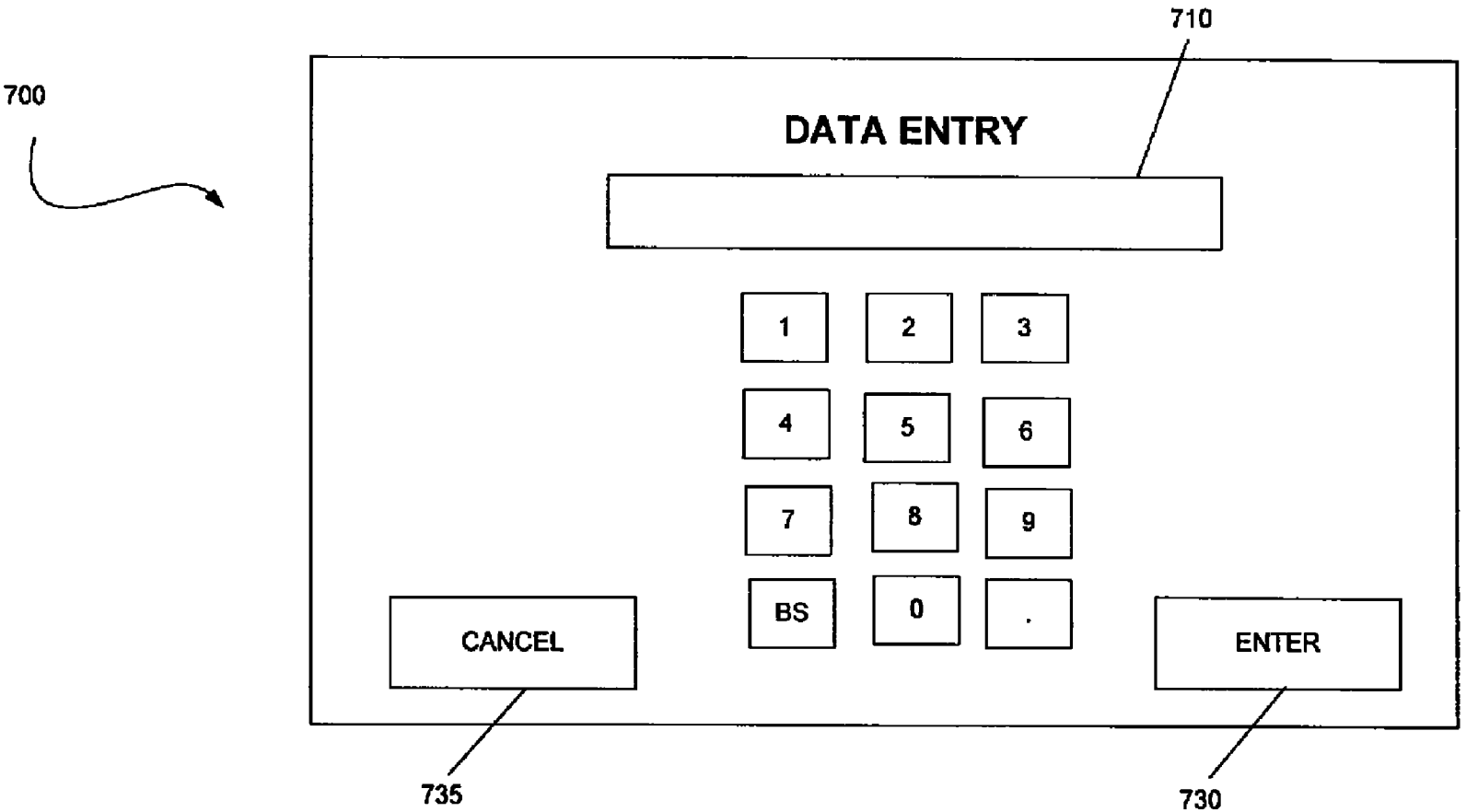
FIG. 6 illustrates an exemplary data entry screen for an operator interface of a commercial refrigeration system.

FIG. 5 shows an exemplary operator interface screen for displaying a suction pressure set-point 605 and a suction pressure sensed value 610. Pressing or clicking the suction pressure set-point 605 displays a data entry screen 700 (FIG. 6). In some embodiments, a password entry screen (not shown) may display to prevent unauthorized users from changing the suction pressure set-point 605.

The operator can enter a new suction pressure set-point by pressing the appropriate number buttons. A display window 710 displays the value of the number that has been entered. A backspace ("BS") button allows numbers entered in error to be erased. Once the new suction pressure set-point is entered the operator can press the enter button 730, which enters the new suction pressure set-point into the commercial refrigeration system and displays the suction pressure set-point screen 600. A cancel button 735 allows the operator to return to the suction pressure set-point screen 600 without entering a new set-point.

Figure 7:
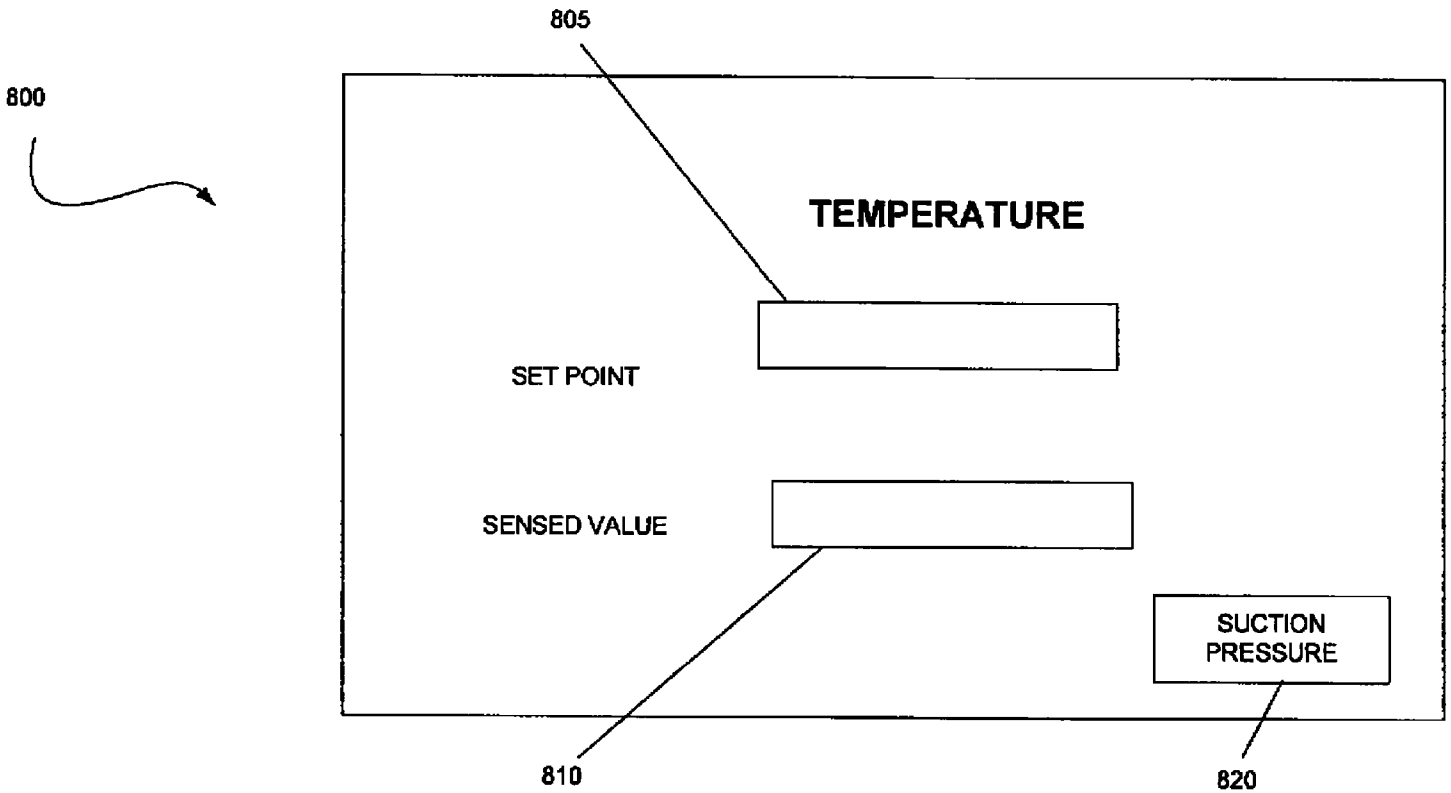
FIG. 7 illustrates an exemplary operator interface screen for entering a temperature set-point into a commercial refrigeration system.

Pressing a temperature button 750 on the suction pressure set-point screen 600 displays a temperature set-point screen, such as the exemplary operator interface screen 800 in FIG. 7. The screen 800 displays a temperature set-point 805 and a sensed temperature value 810. Pressing or clicking the temperature set-point 805 displays the data entry screen 700. In some embodiments, a password entry screen (not shown) may display to prevent unauthorized users from changing the temperature set-point 805.

The operator can enter a new temperature set-point as was described above for entering the suction pressure set-point. Pressing a suction pressure button 820 on the temperature set-point screen 800 displays the suction pressure set-point screen 600.

Figure 8:
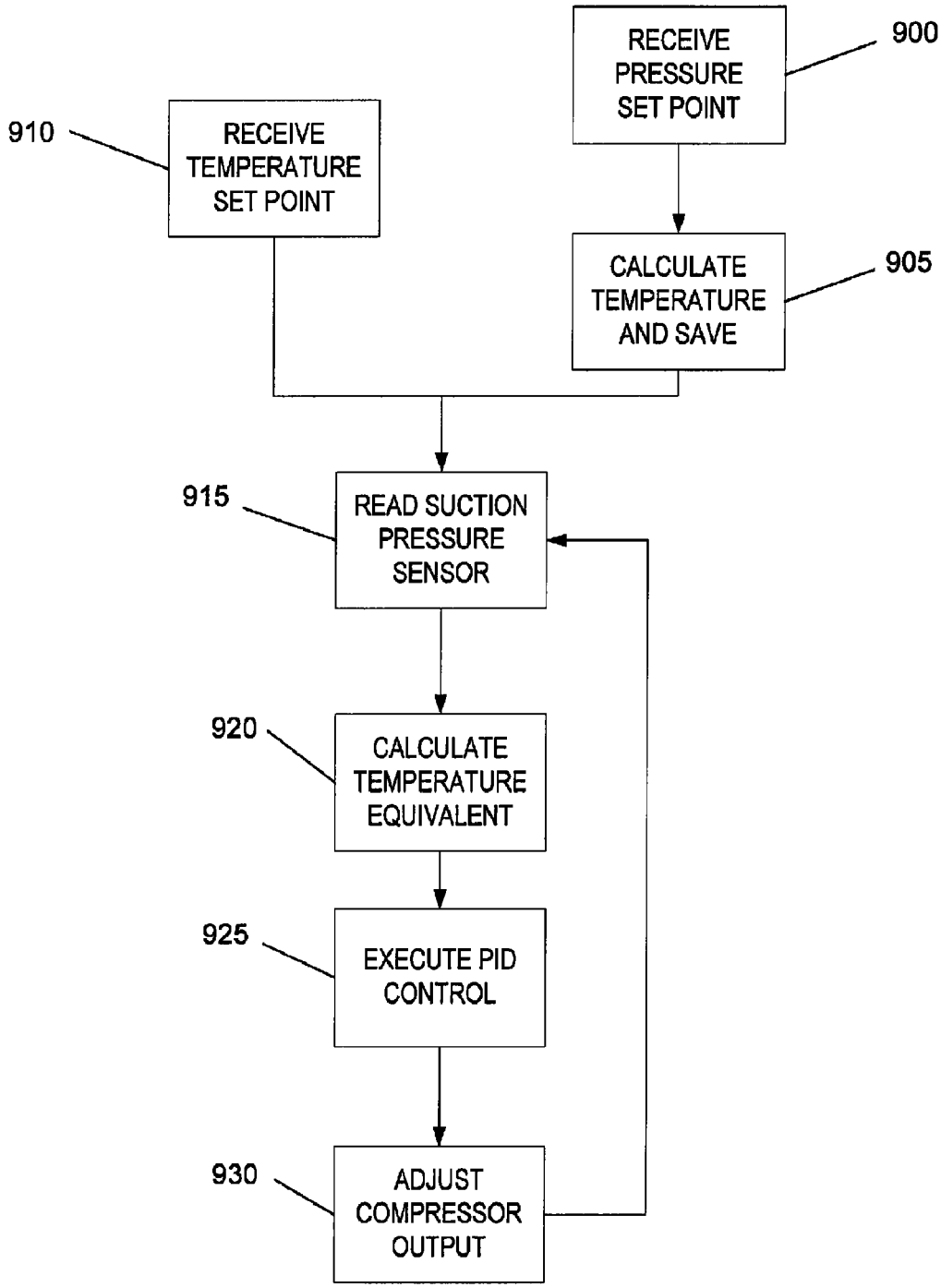
FIG. 8 illustrates a flow chart of an embodiment of a process for controlling a commercial refrigeration system using a linearized proportional-integral-controller of the invention.

FIG. 8 is a flow chart of an embodiment of a process for a commercial refrigeration system 100 implementing a linearized PID controller. The PID controller receives a set-point, either as a suction pressure value (block 900) that is converted to an equivalent temperature (block 905), or directly as a temperature value (block 910).

Operation of the controller begins with reading the suction pressure (block 915) from the pressure sensor 125. The sensed pressure is then converted to an equivalent temperature (block 920) either by calculating the equivalent temperature for the type of refrigerant used in the commercial refrigeration system 100 or by using a look up table for the refrigerant used in the commercial refrigeration system 100. The look up table can have a corresponding temperature equivalent for each pressure or the controller can extrapolate between the two pressures recorded in the table nearest to the actual pressure sensed in order to determine an equivalent temperature. In some embodiments, the controller stores the formulas necessary to perform the calculations and/or the look up tables for a plurality of refrigerant types. In some other embodiments, the controller stores the formulas necessary to perform the calculations and/or the look up table for a single refrigerant type.

The temperature set-point and the temperature equivalent of the sensed suction pressure are used as inputs to the PID controller (block 925), which executes based on these values and its tuning parameters. The PID controller is able to operate over a relatively wide range of temperature set-points because of the linearity of the temperature parameters it is operating on. The non-linearity of the suction pressures for a refrigerant over the range of temperature set-points does not impact the control of the commercial refrigeration system.

The PID controller produces a control output which is used to adjust the output of the compressors 105 (block 930) in an attempt to move the temperature equivalent of the sensed suction pressure toward the temperature set-point. Processing then continues at block 915 with reading the sensed suction pressure. Delays can exist in the system between the time at which the PID controller produces the control output and the time at which system operation changes in accordance with the control output. Because of the delays inherent in the system, the suction pressure can be read by the PLC relatively long before adjustments to the compressor output made at block 930 have an impact on the suction pressure. The I and D parameters allow the PID controller to account for the delays and enable stable operation of the compressors 105 of the commercial refrigeration system 100.

Various features and advantages of the invention are set forth in the following claims.

The invention claimed is:

1. A controller for a commercial refrigeration system for cooling a plurality of spaces, two or more of the plurality of spaces cooled to a respective temperature, the controller linearly operable over a temperature range, the controller comprising:

a sensor configured to detect a suction pressure;

a converter configured to convert the suction pressure to an equivalent temperature; and a proportional-integral-derivative controller configured to receive the equivalent temperature and a temperature set-point representing a desired temperature for at least one of the plurality of spaces as control variables, and a set of static control parameters, and to generate an output, the output controlling a plurality of compressors and providing linear control over the temperature range, wherein the suction pressure is not linear over the temperature range, and the static control parameters remain constant over the temperature range.

2. The controller of claim 1 wherein the equivalent temperature is a function of the sensed suction pressure and a type of refrigerant.

3. The controller of claim 1 wherein the equivalent temperature is determined by a calculation.

4. The controller of claim 1 wherein the equivalent temperature is determined by accessing a lookup table.

5. The controller of claim 1 wherein the converter is configured to convert a pressure set-point to the temperature set-point.

6. A linear control method for a commercial refrigeration system, the method comprising:

providing a set of control parameters to a controller, the set of control parameters static over the controller's range of operation;

providing a temperature set-point as a first control variable to the controller;

sensing a suction pressure, the suction pressure being nonlinear over the controller's range of operation;

determining a temperature equivalent to the sensed suction pressure;

providing the temperature equivalent as a second control variable to the controller; and adjusting an output of the controller based on a magnitude of a difference between the temperature set-point and the temperature equivalent, wherein the adjusted output of the controller modifies operation of at least one of a plurality of compressors in the commercial refrigeration system.

7. The method of claim 6 wherein the temperature equivalent is a function of the sensed suction pressure and a type of refrigerant.

8. The method of claim 6 wherein the temperature equivalent is determined by a calculation.

9. The method of claim 6 wherein the temperature equivalent is determined by accessing a lookup table.

10. The method of claim 6 wherein the controller is a proportional-integral-derivative controller.

11. The method of claim 6 and further comprising converting a pressure set-point to the temperature set-point.

12. The method of claim 6 wherein the adjusted output of the controller modifies operation of a plurality of compressors in the commercial refrigeration system.

* * * * *